US007997196B2

(12) United States Patent
Whelan

(10) Patent No.: US 7,997,196 B2
(45) Date of Patent: Aug. 16, 2011

(54) PORTABLE INTAGLIO PRINTING PRESS

(76) Inventor: Paul L. Whelan, Plano, TX (US)

( * ) Notice: Subject to any disclaimer, the term of this patent is extended or adjusted under 35 U.S.C. 154(b) by 1053 days.

(21) Appl. No.: 11/786,292

(22) Filed: Apr. 10, 2007

(65) Prior Publication Data

US 2008/0250953 A1 Oct. 16, 2008

(51) Int. Cl.

| | |
|---|---|
| ***B41F 3/20*** | (2006.01) |
| ***B41F 3/36*** | (2006.01) |
| ***B41F 3/04*** | (2006.01) |
| ***B41B 5/08*** | (2006.01) |
| ***B41L 35/16*** | (2006.01) |
| ***B41L 29/08*** | (2006.01) |
| ***B41L 15/02*** | (2006.01) |

(52) U.S. Cl. ..... 101/269; 101/150

(58) Field of Classification Search ..... 101/163, 101/158, 161, 162, 159, 160, 269, 250, 474, 101/146, 316, 317, 287

See application file for complete search history.

(56) References Cited

U.S. PATENT DOCUMENTS

| | | | | |
|---|---|---|---|---|
| 1,958,299 | A | 10/1930 | Ericksson | |
| 2,179,746 | A | 11/1939 | Laszlo | |
| 2,715,361 | A * | 8/1955 | Lasseter | 101/212 |
| 3,067,676 | A | 12/1962 | Dickerson | |
| 3,179,046 | A * | 4/1965 | Maul et al. | 101/269 |
| 3,299,803 | A * | 1/1967 | Taylor | 101/5 |
| 3,561,359 | A * | 2/1971 | Cohen | 101/250 |
| 3,633,505 | A | 1/1972 | Ferrari | |
| 3,818,829 | A * | 6/1974 | Patterson, Jr. | 101/269 |
| 3,842,738 | A | 10/1974 | Terrazas et al. | |
| 4,704,962 | A * | 11/1987 | Healey | 101/269 |
| 6,216,590 | B1 | 4/2001 | Whelan | |

OTHER PUBLICATIONS

Daniel Smith Online Reference Catalog 2006-2007, p. 97, http://www.danielsmith.com/search.asp (last visited Apr. 10, 2007).

The Whelan Uber Press, Online Instruction Video, Jul. 12, 2007 http://www.whelanpress.com/uber_press.aspx.

* cited by examiner

*Primary Examiner* — Daniel J Colilla
*Assistant Examiner* — Leo T Hinze
(74) *Attorney, Agent, or Firm* — Rudolph J. Buchel, Jr

(57) ABSTRACT

The present invention is directed to a novel intaglio printing press and a method for intaglio print making using the intaglio printing press described herein. The present invention is comprised generally of two assemblies: a press bed assembly and a print head assembly. The print head assembly serves as a first class lever within a pair of surfaces of a press bed assembly that define runway. The runway structure of the press bed assembly confines the force applied to the print head assembly and translates that force into a pressure directed to the print paper covered and inked artwork. The print paper and inked artwork are positioned proximate to the lower surface and the print head portion of the print head assembly is situated between the artwork and the upper surface. The print head assembly comprises one or more lever handles, a compression roller and one or more track roller. The lever handle(s) provide a torque lever for receiving a manually exerted downward force and to provide a handle for moving the print head assembly along the runway, thereby making compression passes across the artwork. The track roller and compression roller are secured a predetermined distance from each other and within a housing that forces the compression roller against the print paper and inked artwork at the lower surface of the runway and simultaneously forces the track roller (or bearings) against the upper surface of the runway. Printmaking proceeds one pass at a time across the lateral extent of the print paper covered artwork.

20 Claims, 12 Drawing Sheets

FORCE2 = $(l_1/l_2)$ X FORCE1;
FORCE ON PLATEN = FORCE1 + FORCE2;
FORCE ON PLATEN = $(1+l_1/l_2)$ x FORCE1

PORTABLE INTAGLIO PRINTING PRESS

BACKGROUND OF THE INVENTION

1. Field of the Invention

The present invention relates generally to printing presses. More particularly, the present invention relates to a method for intaglio print making and an intaglio printing press used therein.

2. Description of Related Art

The term intaglio refers to a die used in printing that is incised so as to produce an image in relief. Generally, an intaglio printing die has incisions, depressions and recessed areas that are marked into a plate of copper, brass, iron, zinc, or even plastic or linoleum. Many different processes and techniques may be employed in making an artwork die from the substrate plate which are suitable for intaglio printing, but a discussion of these techniques is beyond the scope of this application.

The basic methods of intaglio printmaking have remained relatively unchanged for centuries. Once an image has been incised onto a plate, ink is spread on the plate and forces it into the recessed areas of the plate. The surface is wiped clean of ink, leaving only the ink in the recessed areas of the plate. The plate is then placed in a special press and the paper that will receive the intaglio print is registered, face down, on the plate. It should be mentioned that one characteristic of intaglio prints that make them so desirable is the plate mark received in the paper from the outline of the plate, so care is taken that the paper is registered correctly to the plate. Often the paper is dampened to make it receptive to the ink and more supple so that the paper can more easily be pressed into the incised marks (dampening the paper also enhances the print mark). One or more felt blankets are placed over the paper in preparation for the press. The press applies direct pressure to the felt, which compresses the felt, and more importantly, the paper into the inked relief of the image on the plate.

Two general designs of printing presses suitable for intaglio printmaking have been used; a screw-type press that compresses the entire surface of the artwork between two flat plates, and a cylinder-type press that applies rotational pressure on the artwork at a point between two larger cylinders and simultaneously feeds the artwork plate, paper and felt in the direction of rotation. The screw-type press design has been in continuous use since the fifteenth century. It is simple to operate, relatively easy to maintain and has relatively few wear parts to replace. One major drawback in the screw-type design is that because force is simultaneously applied over the entire surface area of the work surface, the working pressure is inversely proportional to the surface area of the workpiece. The larger the work surface, the lower the amount of pressure that can be generated from the force applied by the screw. As a practical matter, the performance of most screw-type designs drops off considerably over a few hundred square inches of surface area.

Cylinder-type intaglio printing presses do not suffer from this shortcoming because the pressure to the workpiece is applied along a line between two cylindrically shaped rollers. Essentially, the cylinder-type design applies pressure in only one direction along the work surface, rather than across the entire two-dimensional surface area of the work surface as in the screw-type device. Because the surface area between the contact points on the rollers is relatively small, the cylinder-type design enables the operator to focus a significant amount of surface pressure with a comparatively low force applied on the rollers. Therefore, the length of the roller can be increased to accommodate larger artwork without a substantial corresponding decrease in the working pressure common to the screw-type press design.

BRIEF SUMMARY OF THE INVENTION

The present invention is directed to a novel intaglio printing press and a method for intaglio print making using the intaglio printing press described herein. A lightweight and portable intaglio printing press is disclosed that enables an operator to manually generate the amount of compressive force that is necessary to emboss quality intaglio prints from artwork. The present invention is comprised generally of two assemblies: a press bed assembly and a print head assembly. The design of a novel print head assembly serves as a first class lever within a pair of surfaces of a press bed assembly that define runway. The runway structure of the press bed assembly confines the force applied to the print head assembly and translates that force into a pressure directed to the print paper covered and inked artwork. The runway structure is defined by upper and lower surfaces of the press bed assembly that are separated by a predetermined distance and substantially parallel to each other. The print paper and inked artwork are positioned proximate to the lower surface and the print head portion of the print head assembly is situated between the artwork and the upper surface.

The print head assembly comprises one or more lever handles, a compression roller and one or more track roller. The lever handle(s) serves at least two purposes: to provide a torque lever for receiving a manually exerting downward force and translating that force into compression force on the artwork and print paper (in conjunction with the surfaces of the runway structure); and to provide a handle for moving the print head assembly along the runway, thereby making compression passes across the artwork. The track roller and compression roller are secured a predetermined distance from each other and within a housing that forces the compression roller against the workpiece (the print paper and inked artwork) at the lower surface of the runway and simultaneously forces the track roller (or bearings) against the upper surface of the runway. Printmaking proceeds one pass at a time across the lateral extent of the print paper covered artwork. Rather than drawing the workpiece past a pair of rollers using the rotation of the rollers, as is typical of prior art presses, the workpiece is moved perpendicularly with respect to the direction of the print head passes, thereby exposing a fresh area of the workpiece for imprinting.

BRIEF DESCRIPTION OF THE SEVERAL VIEWS OF THE DRAWINGS

The novel features believed characteristic of the present invention are set forth in the appended claims. The invention itself, however, as well as a preferred mode of use, further objectives and advantages thereof, will be best understood by reference to the following detailed description of an illustrative embodiment when read in conjunction with the accompanying drawings wherein:

Other features of the present invention will be apparent from the accompanying drawings and from the following detailed description.

DETAILED DESCRIPTION OF THE INVENTION

| Element Reference Number Designations | |
|---|---|
| 1: | Cylinder-Type Press |
| 10: | Upper Roller |
| 12: | Pressure Device |
| 14: | Drive Mechanism |
| 20: | Lower Roller |
| 30: | Press Bed |
| 31: | Stationary Press Bed |
| 32: | Artwork |
| 34: | Paper |
| 36: | Felt Layers |
| 40: | Trolley |
| 100: | Portable Intaglio Press |
| 102: | Press Bed Assembly |
| 104: | Runway |
| 110: | Print Head Assembly |
| 110A: | Print Head in Parked Position |
| 110B: | Print Head in Ready Position |
| 110C: | Print Head in Operational Position |
| 111: | Magnet |
| 112: | Print Head |
| 113: | Handle (lever) |
| 114: | Pillow Block Frame |
| 115: | Deck |
| 116: | Print Roller |
| 117: | Axle |
| 118: | Bearing |
| 119: | Bearing Axle |
| 120: | Upper Beam Assembly |
| 121: | Upper I-Beam Structure |
| 122: | Wear Plate |
| 124: | Adjustment Slot |
| 130: | End Plate |
| 132: | Beam Leg |
| 134: | Roller Height Gauge |
| 135: | Pointer |
| 136: | Table Top Adjustment Lever |
| 140: | Lower Beam assembly |
| 141: | Lower I-Beam Structure |
| 142: | Table Top Beam |
| 150: | Wing Assembly |
| 152: | Wing |
| 154: | Wing Guide |
| 156: | Wing Brace |
| 162: | Platen |
| 164: | Artwork |
| 166: | Transfer Paper |
| 168: | Absorption Paper |
| 170: | Felt |
| 210: | Print Head Assembly |
| 210A: | Print Head in Operational Position |
| 210B: | Position Showing Tactual Feedback |
| 211: | Magnet |
| 212: | Print Head |
| 213: | Handle (lever) |
| 214: | Pillow Block Frame |
| 215: | Deck |
| 216: | Print Roller |
| 217: | Axle |
| 218: | Bearing |
| 219: | Bearing Axle |
| 220: | Pressure Spring |
| 222: | Elongated Slot |

Figure 1A:
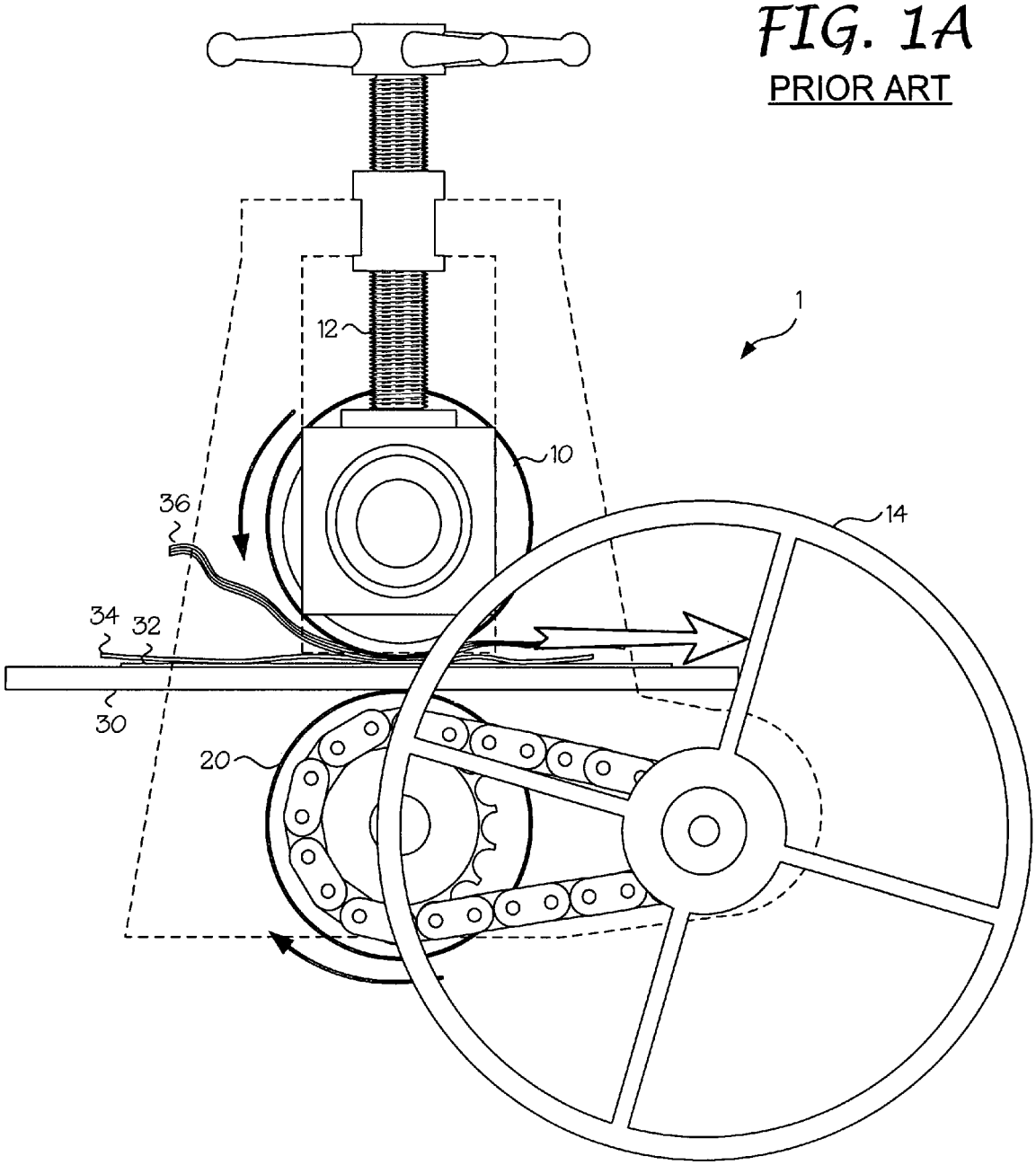
FIG. 1A PRIOR ART
FIG. 1A is a diagram of a cylinder press suitable for intaglio printmaking as is known in the prior art that utilizes a movable bed.
Figure 1B:
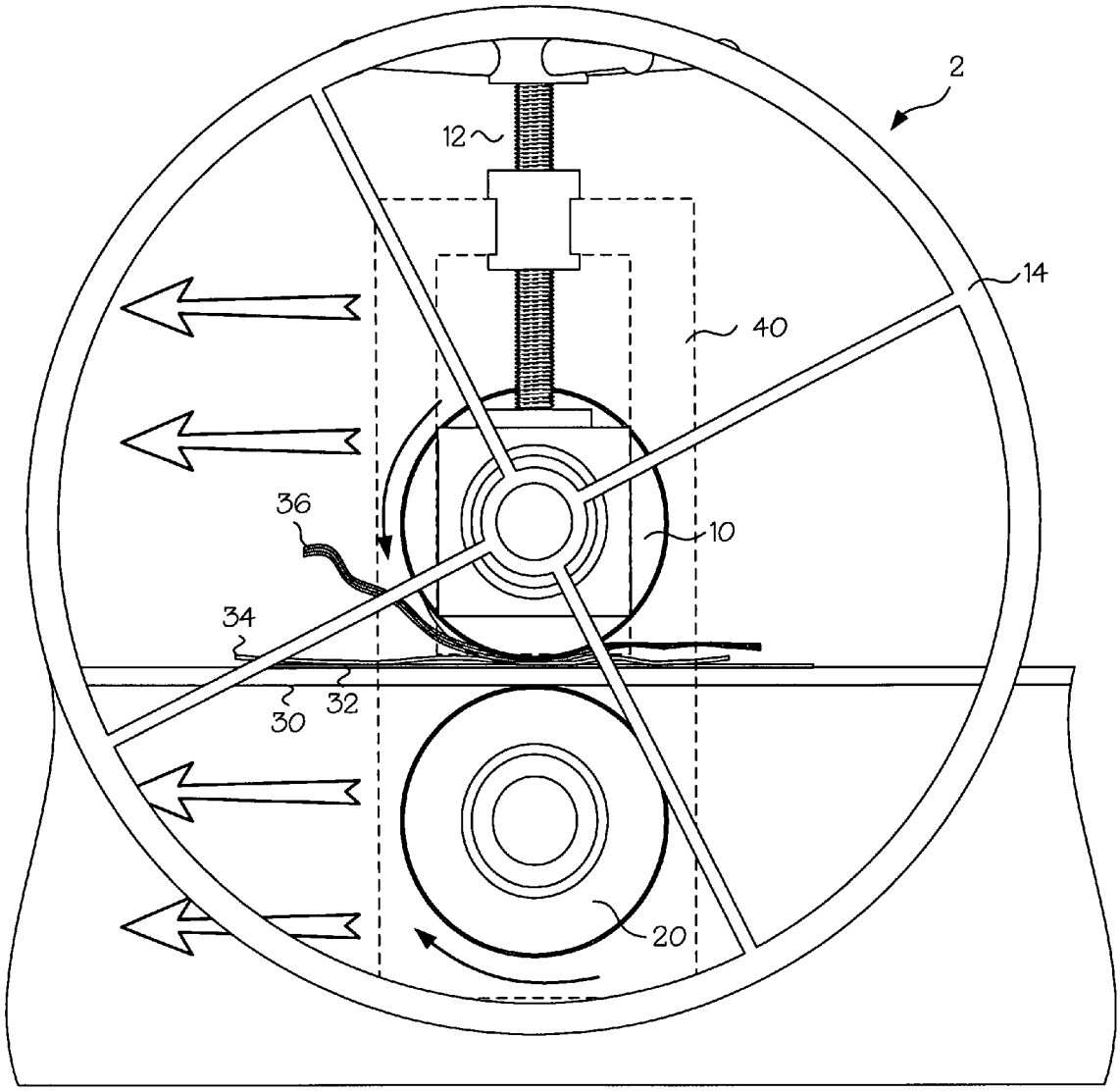
FIG. 1B PRIOR ART
FIG. 1B is a diagram of a cylinder press suitable for intaglio printmaking as is known in the prior art that utilizes a stationary bed and a movable trolley.

FIGS. 1A and 1B are diagrams of cylinder-type printing presses suitable for intaglio printmaking as is known in the prior art. FIG. 1A depicts a movable bed press and FIG. 1B shows a stationary bed press, such as that disclosed in U.S. Pat. No. 6,216,590 to Whelan entitled "Light Weight Intaglio Printing Press," which is incorporated by reference herein in its entirety. Printing presses 1 and 2 are characterized by two large cylindrically shaped rollers, in which the artwork 32, paper 34 and one or more blankets 36 are pulled through the rollers in the direction of their rotations. In some press designs, e.g., press 1 shown in FIG. 1A, one roller provides the compression force to press paper 34 into artwork 32, i.e., upper roller 10 translates force from pressure device 12 to lower roller 20. In accordance with this particular design, upper roller 10 rotates freely about its axle. The second roller, lower roller 20, provides the rotational force necessary to pull the artwork, paper and felt, between the rollers. In this configuration, the position of upper roller 10 is vertically adjustable to achieve a predetermined pressure, while lower roller 20 is secured in a stationary position in the press frame. A chain and sprocket or gear reduction may be employed to lower the ratio to drive mechanism (hand wheel) 14, thereby reducing the manual force necessary to pull an image (alternatively, a motor may be connected to the sprockets).

Alternatively, and as shown in FIG. 1B, drive mechanism 14 for providing the rotational force may be coupled directly to upper roller 10, thus providing both the pressure and drive force to the same roller. Here, pressure is applied to roller 10 by pressure device 12 and the drive force is applied to the same roller by manually turning hand wheel 14. It is understood that the diameter of the hand wheel should be increased proportional to the gear ratio shown in the preceding diagram in order to realize a corresponding reduction the effort. In this particular design, the workpiece remains stationary with regard to the printer bed, while trolley 40 (which includes rollers 10 and 20 and pressure device 12) move in the direction of the rotation of the rollers and with respect to the stationary bed.

In operation, the operator inks the incised plate and forces the ink into the recessed areas of the plate. Next, the operator wipes the surface of the plate clean of ink and places artwork 32 on press bed 30. Often, bed 30 will be ruled with a square or rectangular grid, to which artwork 32 is registered. A dampened paper is then registered on the grid, face down and over the inked plate. Registering plate 32 and paper 34 to the grid ensures that the plate mark will be transferred into the paper at the proper orientation. One or more felt blankets 36 are placed over paper 34 and fed along table 30 and between upper and lower rollers 10/20. Next, rotational force is applied to the drive roller, with regard to FIG. 1A, lower roller 20. The drive roller rotates in a corresponding direction as the drive force causing artwork 32, paper 34, felt 36 and bed 30 to be pulled across the rollers in a direction perpendicular to the rotational axes of the rollers. The finished print exits the opposite side of presses 1 and 2 and paper 34 is separated from artwork 32 and felt 36. The finished print is then allowed to dry.

Alternatively, and with regard to press 2 depicted in FIG. 1B, upper roller 10 and lower roller 20 may be secured in a movable trolley 40 which rolls across and applies a compressive force to stationary table 31 and the artwork thereon. Stationary bed 31 remains motionless with artwork 32, paper 34 and felt 36 as trolley 40 moves along stationary bed 31 as hand wheel 14 is turned.

The design of the cylinder-type intaglio press enables the operator to concentrate an extremely high pressure between the upper and lower rollers by applying a relatively low force to the upper roller. Furthermore, because the force is evenly distributed along the intersection of the rollers, larger artworks can be accommodated by merely lengthening the rollers. However, longer rollers are more susceptible to flexing under pressure, as a result, the rollers must be strengthened. Prior art press designs rely on a large diameter pressure roller (sometimes eight inches in diameter) to compensate for the pushing action against the plate that causes unwanted roller flexing. The wider the press bed, the bigger the diameter of the roller. Often, these prior art presses weigh over 500 pounds due to the large diameter rollers. Relocating these presses is extremely difficult. Once relocated, the press must be properly leveled and aligned to avoid the bed binding. As might be expected, these large rollers are expensive, cumbersome and difficult to replace.

Generally, prior art roller presses that are suitable for intaglio printmaking comprise two large rollers that pull the artwork between them (either in a movable or stationary bed design). The pressure necessary for creating intaglio print is generated between the rollers by applying a force to one or both of the rollers. The prior art roller presses are further characterized by the manner in which they feed the artwork and paper between the rollers, from one side of the rollers to the opposite side of the rollers based on the direction of rotation. While the roller-type press has many advantages over the screw-type, flat plane press, roller-type presses are heavy and expensive. As longer rollers are needed to accommodate larger prints, the diameter of the rollers must be increased to avoid flexing. What is needed is a lightweight and portable intaglio printing press that is easy to setup, operate and maintain that does not rely on large rollers for printmaking.

In accordance with an exemplary embodiment of the present invention, a lightweight and portable intaglio printing press is disclosed below that does not suffer from the shortcomings of the roller-type intaglio printing presses known in the prior art. The present invention enables an operator to generate the amount of compressive force that is necessary to emboss quality intaglio prints from artwork without having to bind the workpiece between a pair of rollers as is well established and understood in the prior art. Furthermore, the present invention enables the operator to manually create a sufficient amount of compressive force for intaglio printmaking. The present invention is comprised generally of two assemblies: a press bed assembly and a print head assembly. The design of a novel print head assembly serves as a first class lever within a pair of surfaces of a press bed assembly that define runway. The runway structure of the press bed assembly confines a force created by the print head assembly and translates that force into pressure on the print paper covered and inked artwork. The bed assembly has a runway structure defined by upper and lower surfaces that are separated by a predetermined distance and substantially parallel to each other. The print paper and inked artwork are positioned against the lower surface and the print head portion of the print head assembly is situated between the artwork and the upper surface. The print head assembly comprises one or more lever handles, a compression roller and one or more track rollers. The lever handle(s) serves at least two purposes: to provide a torque lever for receiving a manually exerting downward force and translating that force into compression force on the artwork and print paper; and to provide a handle for moving the print head assembly along the runway and making compression passes across the artwork. The track roller and compression roller are secured a predetermined distance from each other and within a housing that forces the compression roller against the workpiece (the print paper and inked artwork) residing on the lower surface of the runway and simultaneously forces the track roller (or bearings) against the upper surface of the runway. Printmaking proceeds one pass at a time across the lateral extent of the print paper covered artwork. Furthermore, rather than drawing the workpiece past a pair of rollers using the rotation of the rollers as is typical of prior art presses, the workpiece is not pulled into, by or past the rollers. In fact, the movement of the workpiece does not correspond to the rotation of the compression roller. In short and in stark contrast with the prior art, the operation of the present invention is not dependent on the interaction between a pair of rollers and the workpiece. After each subsequent pass of the print head over the workpiece (or any number of passes that the operator deems sufficient to create the desired affect on the print paper), the workpiece is moved perpendicularly with respect to the direction of the print head passes, thereby exposing a fresh area of the workpiece for imprinting.

The presently described intaglio printing press is lighter and more portable than those known in the prior art, and correspondingly less expensive to fabricate, yet capable of producing intaglio prints that are indistinguishable from those produced by the more expensive presses known in the prior art. At the same time, the intaglio printing press of the present invention is far less complicated to operate than many of the roller-type presses known in the prior art. Furthermore, the present intaglio printing press is relatively easy to maintain having few moving or wear parts to replace. Still further, because the compression roller of the present invention is substantially smaller than those used with previous presses, this roller is much less expensive to replace than those used in the prior art.

Figure 2:
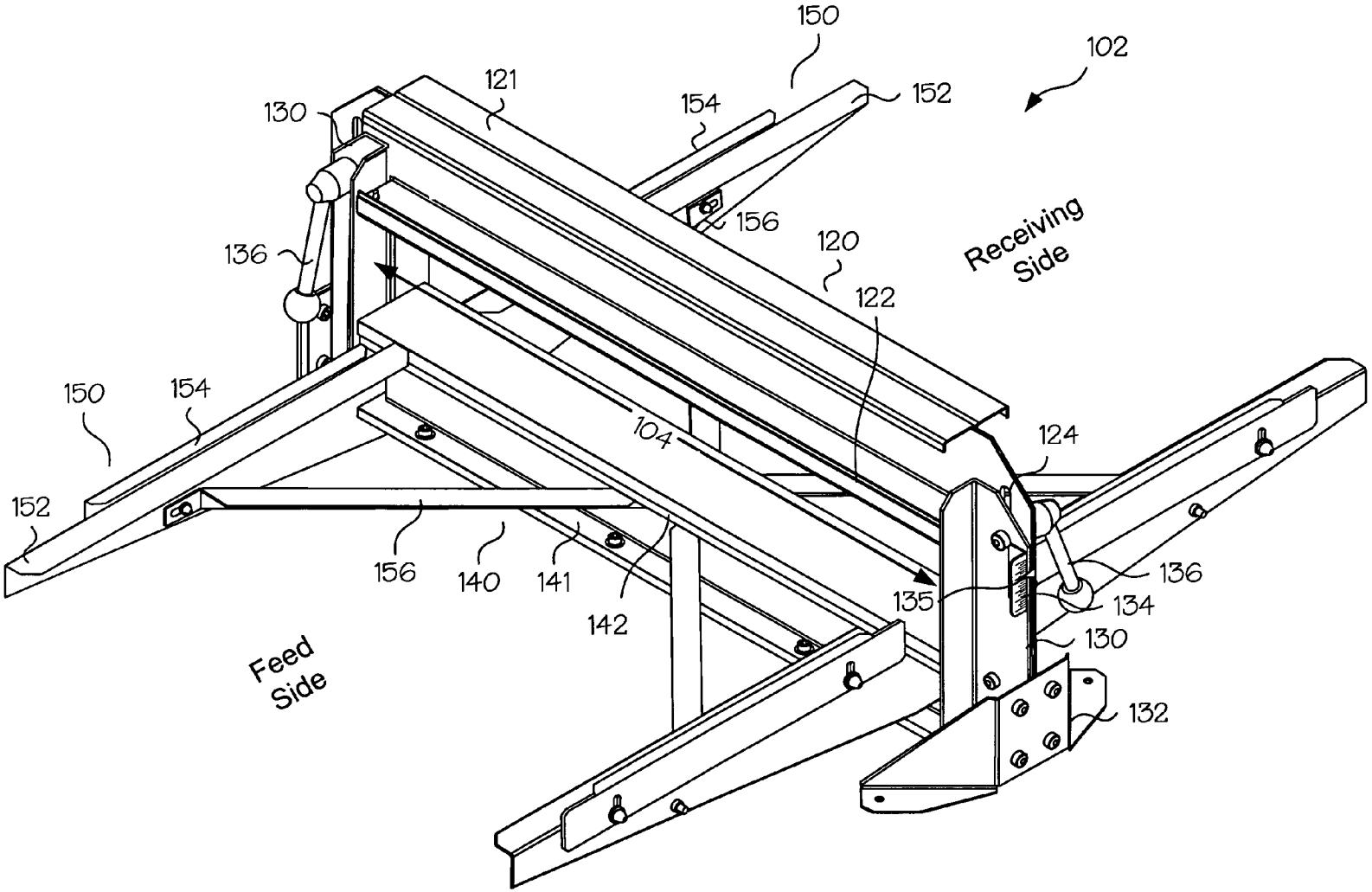
FIG. 2 is an upper isometric view of press bed assembly of a printing press suitable for intaglio printmaking in accordance with one exemplary embodiment of the present invention.
Figure 3:
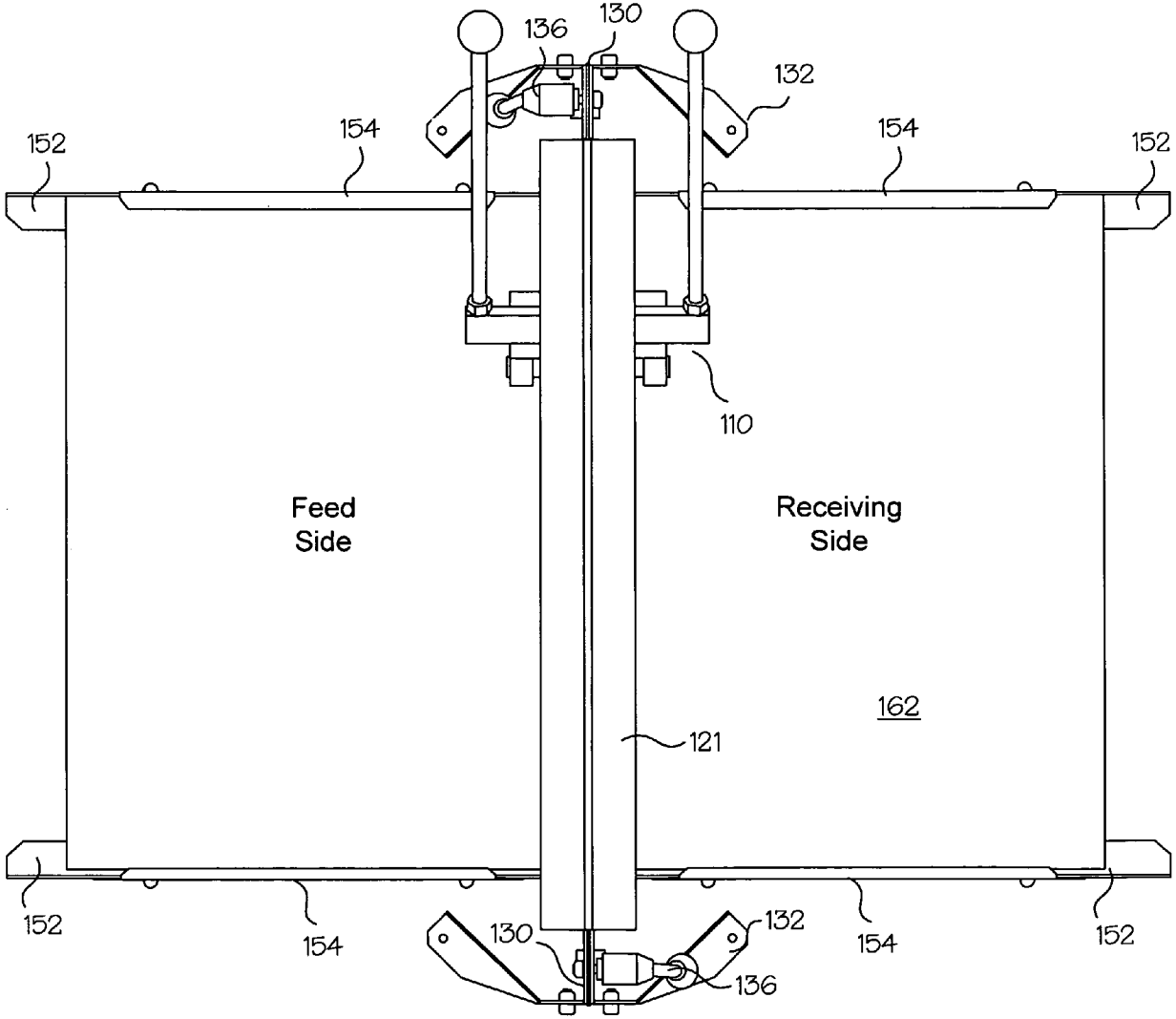
FIG. 3 is a top view of a press bed assembly and a print head assembly of a printing press suitable for intaglio printmaking in accordance with one exemplary embodiment of the present invention.
Figure 4A:
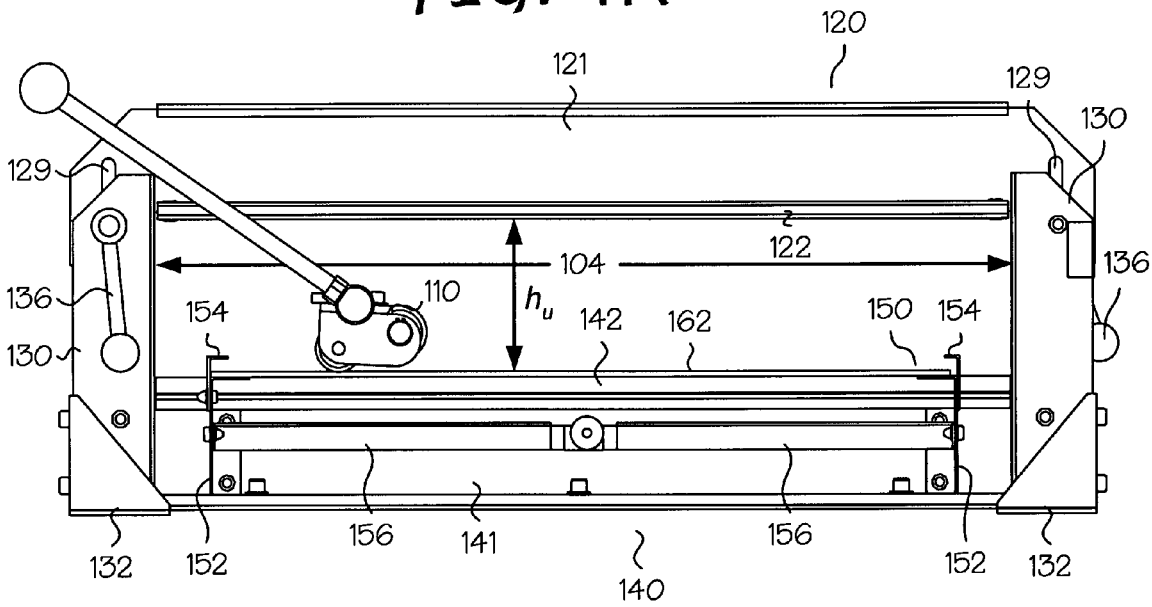
FIG. 4A is a side view of a press bed assembly and a print head assembly of a printing press suitable for intaglio printmaking showing the receiving side of the bed assembly in accordance with an exemplary embodiment of the present invention.
Figure 4B:
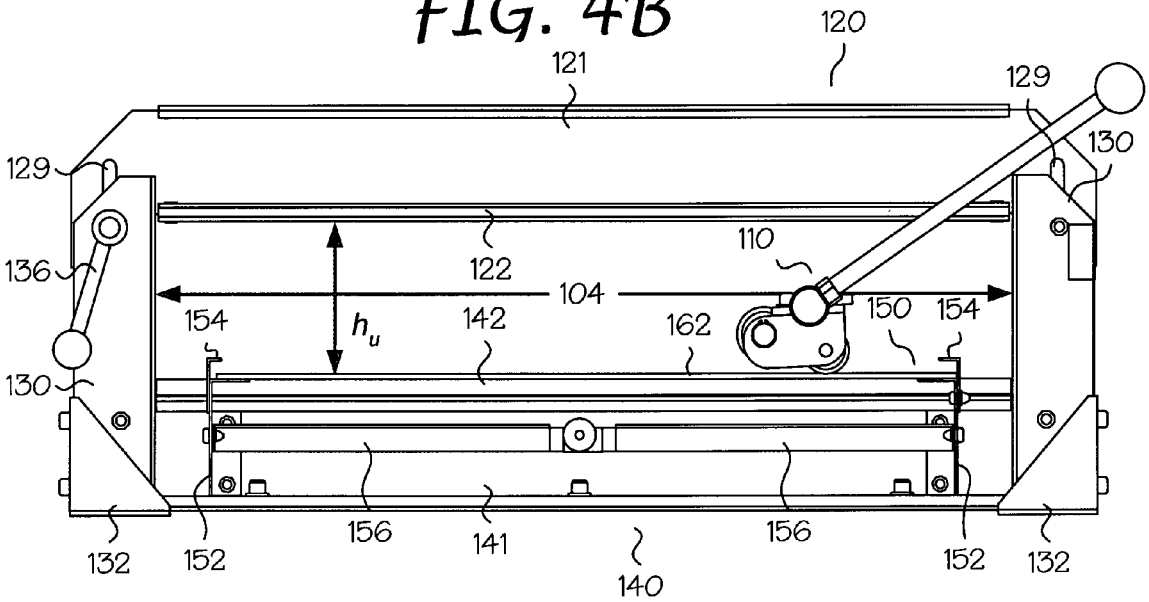
FIG. 4B is the opposite side view of a press bed assembly and a print head assembly of a printing press suitable for intaglio printmaking showing the feed side of the bed assembly in accordance with an exemplary embodiment of the present invention.
Figure 4C:
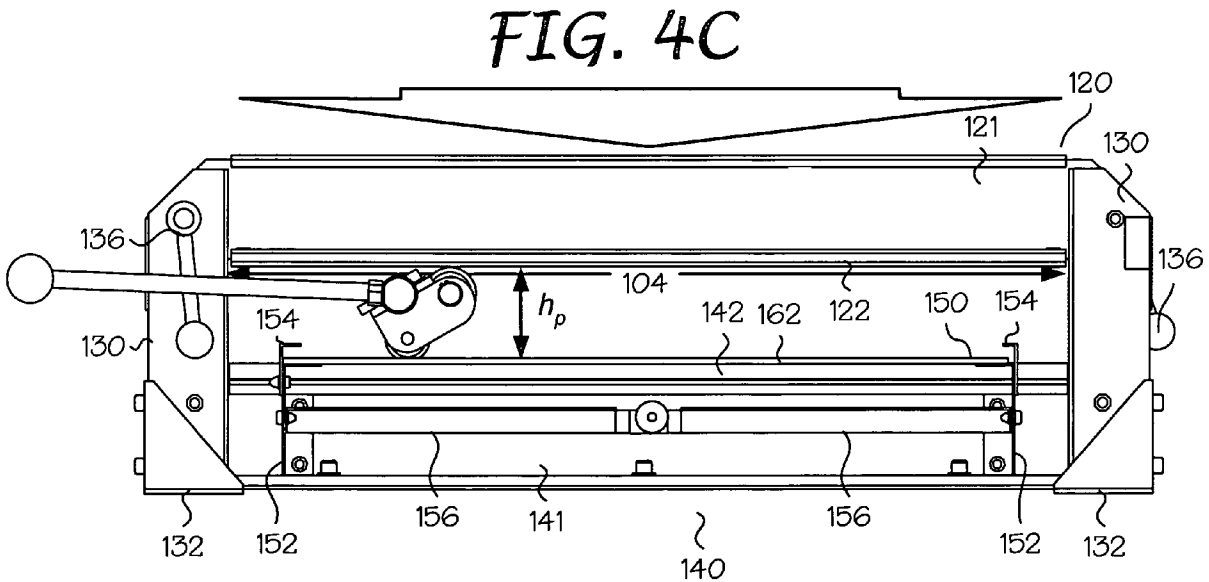
FIG. 4C shows the receiving side of the bed assembly with the upper beam assembly in a lower vertical position in accordance with an exemplary embodiment of the present invention.
Figure 5:
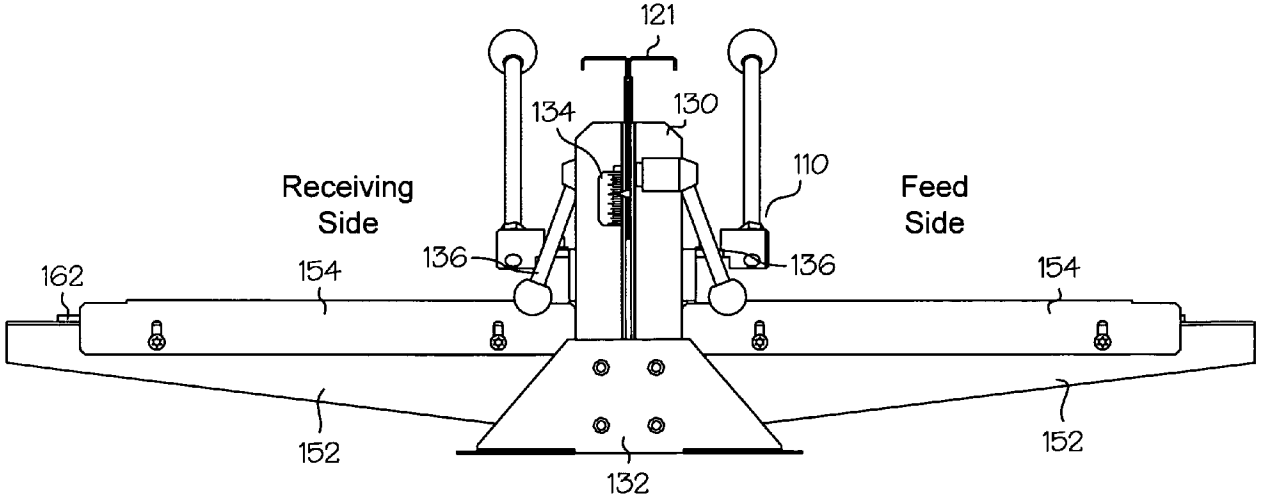
FIG. 5 shows the front view of a press bed assembly and a print head assembly in accordance with an exemplary embodiment of the present invention.

The present invention will be described with regard to FIGS. 2-6. FIG. 2 is an upper isometric view of press bed assembly 102; FIG. 3 is a top view of press bed assembly 102 and print head assembly 110; FIGS. 4A through 4C are side views of press bed assembly 102 and print head assembly 110, FIG. 4A shows the receiving side bed assembly 100 for receiving platen 162 from print head assembly 110, FIG. 4B shows the feed side bed assembly 100 for feeding platen 162 to print head assembly 110, and FIG. 4C shows the receiving side bed assembly 100 in a lower vertical position with print head assembly 110 for applying pressure to platen 162; FIG. 5 shows the front view of press bed assembly 102 and print head assembly 110 and FIGS. 6A through 6G depict various view angles of print head assembly 110.

Figure 6A:
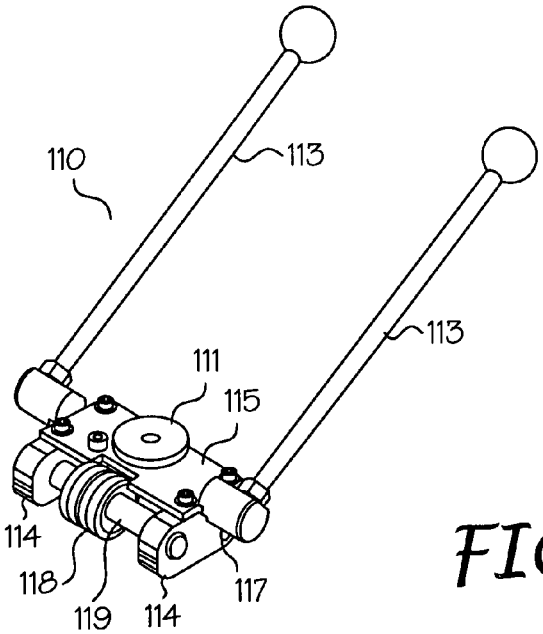
FIG. 6A is an upper isometric view of the print head assembly in accordance with exemplary embodiments of the present invention.

The present invention is comprised generally of two assemblies: a bed assembly (an upper isometric view of press bed assembly 102 is shown separately in FIG. 2) and a print head assembly (an upper isometric view of print head assembly 110 is shown separately in FIG. 6A). Press bed assembly 102 may be considered as having two distinct functions for the purpose of describing its role in the present invention: it provides structural integrity to support the amount of compressive force necessary for intaglio printmaking; and it also provides a platform for slidably holding the artwork, print and felt. With regard to press bed assembly 102 supporting the forces associated with intaglio printmaking, upper beam assembly 120 is adjustably disposed directly over lower beam assembly 140 and each assembly is attached to end plates 130 at their respective ends. The purpose of this configuration is to provide a horizontal runway (references as runway 104) between wear plate 122 on lowermost portion of upper beam assembly 120 and table top beam 142 on the uppermost extent of lower beam assembly 140 for print head assembly 110. In accordance with one exemplary embodiment of the present invention, upper beam assembly 120 comprises upper I-beam structure 121, that has a substantially I-beam cross section, and wear plate 122 that forms or attaches to the lowermost horizontal surface of upper I-beam structure 121. Upper beam assembly 120 extends beyond the I-shaped portion at either end as a substantially planar member that connects to end plates 130. Wear plate 122 should be fabricated from a hard material that creates horizontal raceway for the outside surfaces of bearings 118 (see FIGS. 6A-6G). In accordance with one exemplary embodiment of the present invention, wear plate 122 is comprised of a ferrous material that will be attracted to a magnetic attachment mechanism on print head assembly 110. Wear plate 122 may provide a completely smooth surface or may instead have a channel or guide surface to contain bearings 118 within the area of wear plate 122 during operation. Lower beam assembly 140 also comprises lower I-beam structure 141, but with table top beam 142 forming or adjoining the uppermost horizontal surface of lower I-beam structure 141. Lower beam assembly 140 may also extend beyond the I-shaped portion at either end as a substantially planar member that fastens to end plates 130. Fastener holes may be disposed along the lowermost horizontal surface of lower I-beam structure 141 for receiving fasteners and securing lower beam assembly 140 directly to a work surface, such as a table or bench. The function of table top beam 142 is to provide a rigid structure beneath platen 162 during operation of print head assembly 110 and that allows platen 162 to be easily slid in a direction perpendicular to the beam assemblies and also perpendicular to the travel direction of print head assembly 110. The function of runway 104 will be described in greater detail below.

The vertical dimension of runway 104 (i.e., the gap formed between wear plate 122 and table top beam 142) is adjustable for accommodating workpieces of varying thicknesses, and for altering the working orientation of a pair of handles on print head assembly 110 (the significance of the orientation will also become more apparent with the descriptions further below) In any case, lower beam assembly 140 is rigidly affixed to end plates 130 at either end of the beam, optimally by removable fasteners for portability. By contrast, upper beam assembly 120 is vertically adjustable and connected to end plates 130 through adjustment slots 124 formed in upper beam assembly 120 at either end (compare, for instance, the vertical position of upper beam assembly 120, represented as height $h_u$ as depicted in FIGS. 4A and 4B with the position of upper beam assembly 120 while in the print position, represented as height $h_p$ as depicted in FIG. 4C).

Wear plate 122 and table top beam 142 should be essentially parallel and the distance between them, h, i.e., the runway's height, should be discernable and easily replicated whenever upper beam assembly 120 is moved. Thus, in accordance with another aspect of the present invention, the vertical dimension, h, of runway 104 is indicated on roller height gauge 134. One roller height gauge 134 should be secured at each end plate 130 for leveling upper beam assembly 120 and verifying the wear plate 122 and table top beam 142 are essentially parallel to one another. The measurement is referenced from pointer 135 that extends from the ends of upper beam assembly 120 and across the graduated scale of roller height gauge 134. As the vertical position of upper beam assembly 120 is altered, that height is reflected by pointer 135 on roller height gauge 134. The height measurement indicated on roller height gauge 134 is indicative of the distance between wear plate 122 and table top beam 142, h, but as a practical matter may be a height associated with upper beam assembly 120 that reflects the runway's height h. Other types of vertical height and depth gauges are known that could readily be adapted for making a similar measurement without departing from the scope of the present invention.

As mentioned above, upper beam assembly 120 should be vertically repositionable, but it should also have the rigidity to sustain a substantial upward force without moving from its preset vertical position. Optimally, an operator should be able to effortlessly secure upper beam assembly 120 in position without the use of hand tools. Therefore, in accordance with one exemplary embodiment of the present invention, upper beam assembly 120 is adjustably secured to end plates 130 by a threaded fastened that passes through adjustment slot 124 and secures the beam to each end plate by table top adjustment lever 136. Table top adjustment levers 136 provide leverage for the operator to tighten upper beam assembly 120 in position on end plate 130 without the use of hand tools.

Upper beam assembly 120, lower beam assembly 140 and each of end plates 130 should be fabricated from a light, yet rigid material that retains their shape under substantial pressure, such as extruded aluminum or a similar alloy. The assemblies may be formed as a single piece in a substantially I-, T- or L-shaped cross section, or may instead be assembled from left and right components that are mirror images of each other. For instance, and as depicted in FIGS. 2, 3, 5 and 9, upper I-beam 121 portion of upper beam assembly 120 may be comprised of two U-shaped channels that are fastened together to form an I-shaped member, to which wear plate 122 is then fastened (as mentioned above, a portion of the member should extend beyond the U-shaped channel portions as planar members for coupling to end plates 130). In a similar manner, lower I-beam 141 portion of lower beam assembly 140 may also be comprised of two U-shaped channels that are fastened together to form an I-shaped cross member that table top beam 142 is fastened. As depicted in the figures, end plates 130 have a substantial T-shaped cross section, which may be comprised of left and right L-shaped members that are joined together to form the T. Space is provided between the L-shaped member for receiving the planar member portions of upper beam assembly 120 and lower beam assembly 140. It should be appreciated that the operator's hands will continually move above and below upper beam assembly 120, on either side, and also pass around end plates 130. Sharp or thin edges may present a danger of knick and cuts to the operator and therefore, the exposed edges should be rounded or chamfered to reduce the hazard to the operator.

Each end plate 130 is further secured to a separate beam leg 132 which provides a wide, stable base for the upper and lower beam assemblies. Fastener holes may be provided on the horizontal surfaces of beam legs 132 for securing end plates 130 to a work surface, such as a bench or table.

Figure 9:
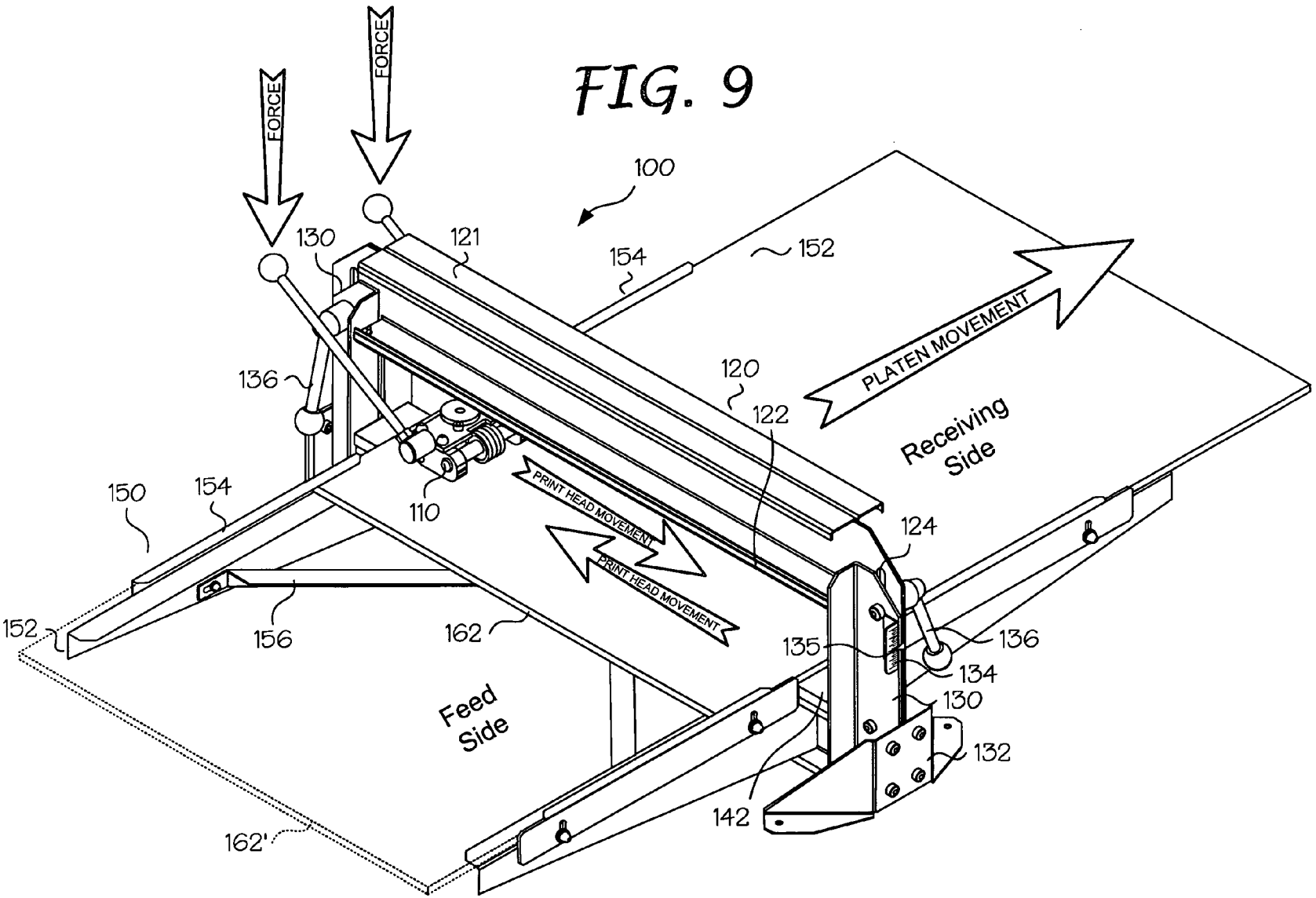
FIG. 9 is an upper isometric view of press bed assembly, print head assembly, patent and workpiece for intaglio printmaking in accordance with another exemplary embodiment of the present invention.

As mentioned above, a second role of press bed assembly 102 is to slidably hold the artwork, print and felt in place during print making. In this regard and with further reference to FIG. 2, a platen support structure is disclosed for slidably holding the platen, with artwork, print and felt, within the runway and in position for making passes with the print head assembly. The platen support structure includes a horizontal platen support structure in the form of four wing assemblies 150, each of which extend perpendicularly from lower beam assembly 140. Two of wing assemblies 150 extend outward from lower beam assembly 140 on the feed side and the other two wings extend outward from the beam assembly on the receiving side. Each wing assembly comprises wing 152, wing guide 154 and optional wing support 156. The four wings 152 provide a stable platform on which the platen 162 rests (see FIG. 9 showing platen 162 resting on wings 152). The two wings on the feed side are substantially parallel to each other and in line with the two wings on the receiving side, which are also parallel. Optional wing supports 156 may be provided and connected from lower beam assembly 140 to each of wings 152 in order to maintain the position and orientation of each wing. Obviously, since the wings provide support of platen 162, the space between them should be less that the width of platen 162 and they all be level with the upper surface of table top beam 142, which also supports the platen. Attached to the upper side of each wing is wing guide 154. The wing guides have an L-shaped cross section, which forms a U-shaped channel with the upper surface of the corresponding wing. Platen 162 is received within U-shaped channel, which act as a guide for moving the platen from the feed side to receiving during operation of the press.

Figure 6B:
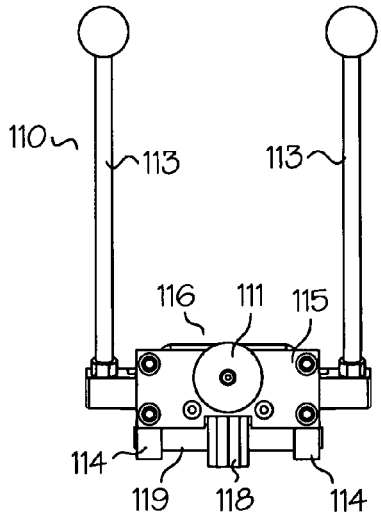
FIG. 6B is an upper view of the print head assembly in accordance with exemplary embodiments of the present invention.
Figure 6C:
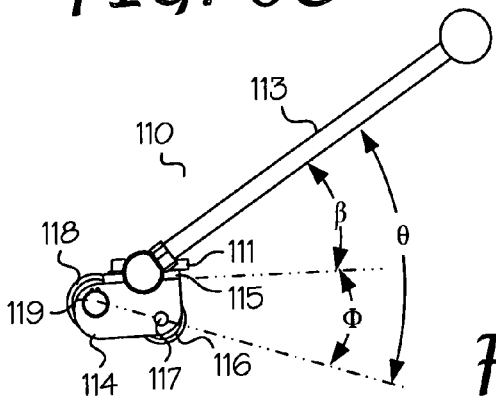
FIG. 6C is a side view of the print head assembly from the receiving side of the press in accordance with exemplary embodiments of the present invention.
Figure 6D:
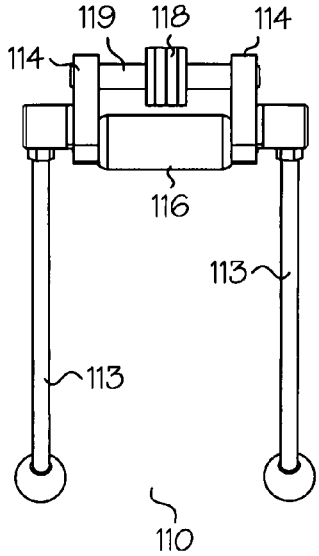
FIG. 6D is a bottom view of the print head assembly in accordance with exemplary embodiments of the present invention.
Figure 6E:
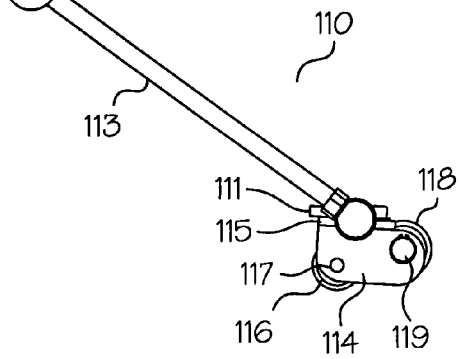
FIG. 6E is a side view of the print head assembly from the feed side of the press in accordance with exemplary embodiments of the present invention.
Figure 6F:
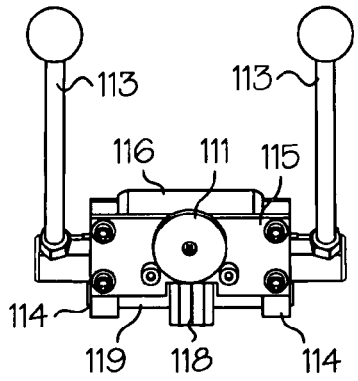
FIG. 6F is an upper rearview of the print head assembly in accordance with exemplary embodiments of the present invention.
Figure 6G:
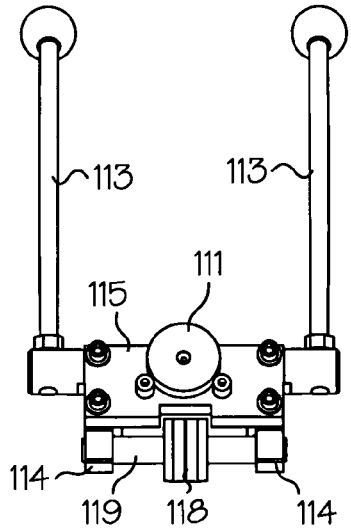
FIG. 6G is an upper front view of the print head assembly in accordance with exemplary embodiments of the present invention.

Turning now to FIGS. 6A through 6G depict various view angles of a print head assembly in accordance with exemplary embodiments of the present invention; FIG. 6A is an upper isometric view of the print head assembly, FIG. 6B is an upper view of the print head assembly, FIG. 6C is a side view of the print head assembly from the receiving side of the press, FIG. 6D is a bottom view of the print head assembly, FIG. 6E is a side view of the print head assembly from the feed side of the press, FIG. 6F is an upper rear view of the print head assembly, and FIG. 6G is an upper front view of the print head assembly. Print head assembly 110 generally comprises a pair of rollers mounted within a housing, with one or more lever handles. More specifically, print roller 116 is held on axle 119 and retained within a pair of pillow block frames 114. Bearing (not shown) may be provided to enable print roller 116 and/or axle 119 to rotate more freely. Pillow block frames 114 are secure to frame deck 115. Print roller 116 is situated on pillow block frames 114 such that the outer edge of the roller extends slightly below and behind pillow block frames 114. Print roller 116 is fabricated from a hard, dense metal and fashioned with a smooth cylindrical surface for embossing the print paper with the inked artwork. Deck 115 and pillow block frames 114 should be manufactured from a medium to high strength material, however because the operator will be generally be required to lift print head assembly 110 off of platen 162 between print passes, the weight of the individual components should be considered. Therefore, a lightweight metal (such as aluminum ) or alloy should be considered for deck 115 and pillow block frames 114.

In accordance with one exemplary embodiment of the present invention, print roller 116 has a nominal diameter of 1.5 inches an axial length of 4.0 inches. It should be understood that the longer the print roller, the more force is necessary to achieve a comparable pressure on the workpiece. For example, assuming a 10:1 mechanical advantage (discussed further below with regard to FIG. 7) for print head assembly 110, 30 lbs. of force applied to the lever arms will result in 300 lbs. of force at print roller 116. If the print roller is 4.0 inches long, and assuming a 0.25 inch of linear contact long the curvature of the arc, then the pressure along the contact area will be 300 psi $$\left(= \frac{300\ \text{psi}}{(4.0 \cdot 0.25)}\right).$$

If, on the other hand, the roller is 8.0 inches long, the effective pressure delivered to the workpiece is reduced by 50%

$$\left(150\ \text{psi} = \frac{300\ \text{psi}}{(8.0 \cdot 0.25)}\right).$$

The same is true for the diameter of the print roller, as it increases, the effective pressure delivered to the workpiece is reduced because the surface area that is in contact with the workpiece also increases.

Track roller 118 is held on axle 117, which is also retained within pillow block frames 114, albeit at the opposite extreme of pillow block frames 114 from print roller 116, i.e., such that the outer edge of track roller extends above and in front of pillow block frames 114. Bearing (not shown) may be provided to enable the roller and/or axle to rotate freely. Alternatively, track roller 118 may comprise one or more bearings that are secured along axle 117 by the inner surface of their cones (the inner race), whereby the outer surface of the cups (the outer race) provides the contact surface to wear plate 122.

Also provided on housing deck 115 is a mechanical coupler for attaching handles (levers) 113 to the housing. As depicted in the example, handles 113 are threaded at one end, with a ball shaped handle at the distal end, although the handle might be fitted with a hand grip or other type of handle. The male threads on handles 113 are received within a female threaded opening on housing deck 115. The coupling mechanism is oriented such that handles (levers) 113 meet the horizontal plane of housing deck 115 at an angle β, where β approximate 45 degree angle (see FIG. 6C). Angle β should be 45 degrees or less (β≧45°) so that the horizontal component (the torque arm) created by lever handles 113 is as long as possible for efficiently exerting force to the platen, but angle β should not be so low that the operator's hands contact the workpiece during operation (i.e., passes across the workpiece). However, in certain operating environments it may be desirable for angle β to be greater than 45 degrees. Here it should be mentioned that the plane of housing deck 115 intersects as a plane across axels 119 and 117 by angle ϕ, and therefore handles (levers) 113 are oriented to that plane by angle ϕ+angle β. For optimal results, the angle ϕ should be adjusted such that handles (levers) 113 are oriented substantially horizontal during operational passes, or at a slight incline inclined to avoid the operator's hands coming in contact with the working surface. Handles 113 should be strong and rigid enough to absorb the force from the operator with little or no flex (it is expected that the handles are solid but the may be fabricated from a high strength round stock or tubular material). Handles 113 are depicted as being generally cylindrical, but may have any cross sectional shape. Additionally, handles 113 should be separated with enough space for the operator's hands to grip the knobs while adjacent to both sides of the upper and lower beam assemblies.

Finally, print head assembly 110 should further comprise an attachment mechanism for temporarily securing print head assembly 110 above the surface of the platen and workpiece when the platen is repositioned. One option is magnet 111 affixed to the upper surface of deck 115. Using magnet 111, the entire print head assembly can be temporally secured to ferrous material of wear plate 122. Alternatively, a magnetic material may be affixed to a portion of upper beam assembly 120 and print head assembly 110 may include a ferrous contact surface which can be temporally secured to the magnetic material. Other types of attachment mechanisms may work equally well, for instance a J hook and receiving slot.

Figure 7:
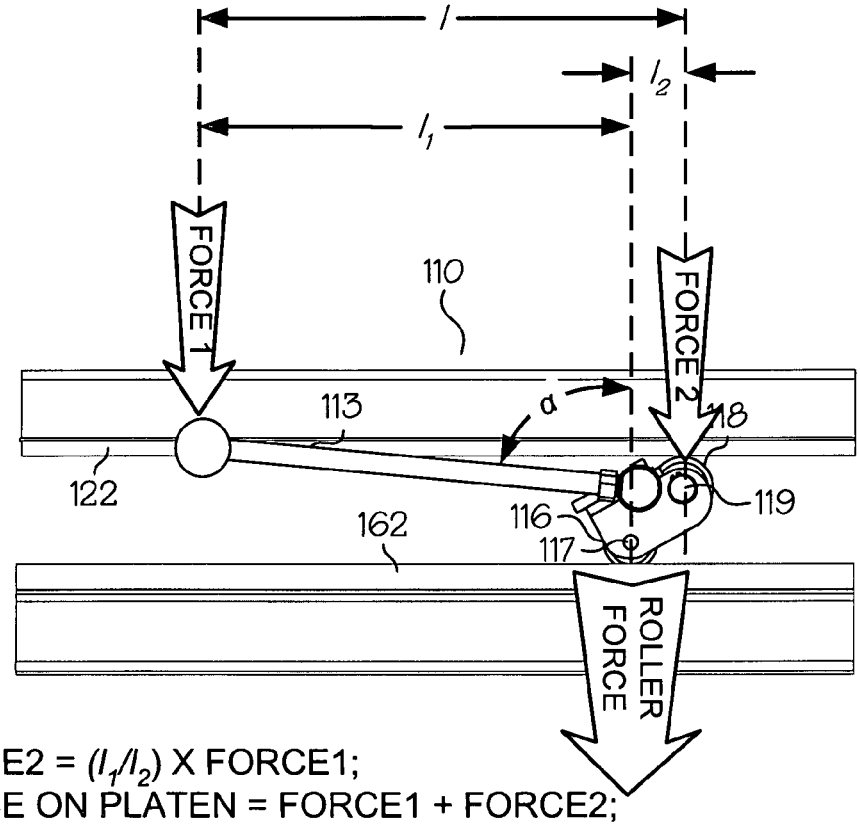
FIG. 7 is a diagram the illustrates the first class lever principle of the print head assembly in accordance with one exemplary embodiment of the present invention.

FIG. 7 is a diagram that demonstrates the mechanics of the first class lever structure of the print head assembly 110 in accordance with an exemplary embodiment of the present invention. In order to calculate the force exerted on platen 162, the magnitude of forces in the downward direction must be found, these are the manual force exerted by the operator and the force exerted by the upper support beam on the track roller. The force at the track roller can be found from torque arm calculations. The operator applies a downward force (FORCE1) at the distal end of lever handles 113, which is a horizontal distance of $I_1$ from the fulcrum (axle 117 of print roller 116). Since print head assembly 110 is in equilibrium, a resistance torque of FORCE2×$I_2$ is created at track roller 118 because track roller 118 is a distance of $I_2$ from the fulcrum (axle 117 of print roller 116. Thus, the force that results at track roller 118, $$FORCE2 = \left(1 + \frac{l_1}{l_2}\right) \times FORCE1.$$

By summing the downward forces, the Print Roller $$\text{Force} = FORCE1 + FORCE2 \text{ or } \left(1 + \frac{l_1}{l_2}\right)$$

Manual Force exerted by the operator on handles 113. Assuming a 10:1 mechanical advantage, then the downward force exerted on the platen by print roller 116 will be approximately 11× the magnitude of the downward force manually exerted on the distal ends of lever handles 113. It should also be mentioned that the length of the torque distance for these calculations is a function of its orientation to the horizontal plane (angle α) in which it is operating (e.g., $I_1$=(length of handle 113×cos(α))).

Figures 8A, 8B:
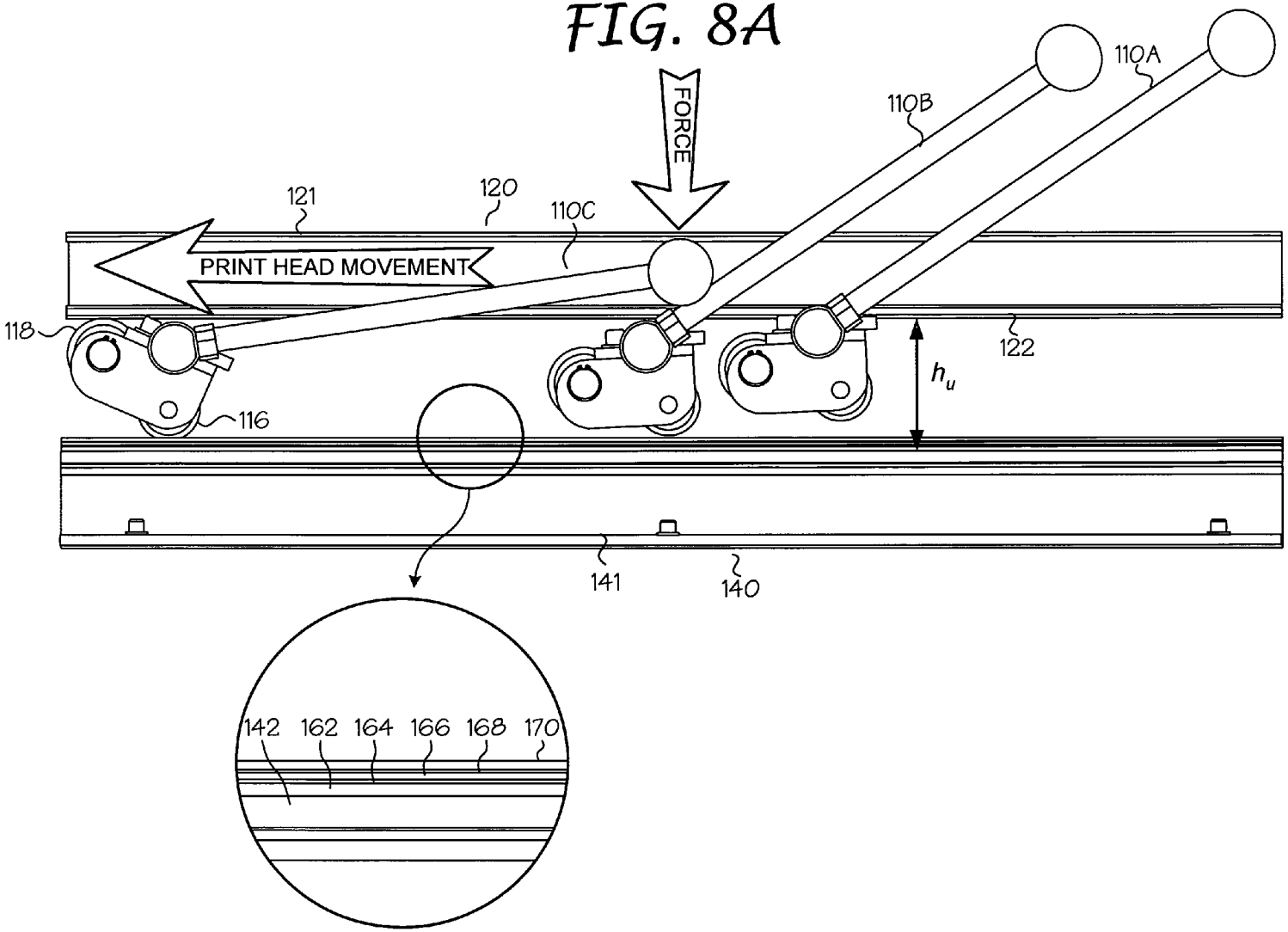
FIG. 8A is a diagram that shows the print head assembly cooperating with the upper and lower beams of the press bed assembly to create a compression force sufficient for intaglio printmaking in accordance with an exemplary embodiment of the present invention.
FIG. 8B is an expanded view of the workpiece that includes the table top beam, platen, artwork, print paper, cover paper, and felt in accordance with an exemplary embodiment of the present invention.

With reference now to FIGS. 8A, 8B and 9, the operation of the presently presented portable intaglio press will be described below. Initially, upper beam assembly 120 is placed at the proper height for the print operation (compare FIG. 4A and FIG. 4C where the upper beam assembly is repositioned for various types of artwork and media). The optimal height of upper beam assembly 120 will generally result in handles 113 being in a horizontal orientation or slightly inclined during operational passes. Print head assembly 110 is in the parked position above the workpiece (represented as position 110A in FIG. 8A). Here, the workpiece may be comprised of various combinations of platen 162, artwork 164, transfer (print) paper 166, one or more optional layers of absorption paper 168 and one or more layers of felt 170.

Platen 162 is secured within the channels formed by the cooperation of wings 152 and wing guides 154. The majority of platen 162 is located on the feed side of press bed assembly 102, although it should be mentioned that the designation of the feed and receiving sides is arbitrary and typically a function of the operator's preference or the layout of the print shop (i.e., the receiving side would be proximate to the drying racks and the feed side closer to the ink, felt and paper stock). Typically, artwork plate 164 is registered on platen 162 (platen 162 may be ruled with a square or rectangular grid, to which artwork 164 is aligned) and ink is spread on plate 164 and forced into the recessed areas of the plate. Care should be taken to keep ink off of the surface platen 162 to avoid contaminating the transfer paper or felt. Any spillage should be cleaned before covering art work 164 with print paper 166. The surface of platen 162 is wiped clean of ink, leaving only the ink in the recessed areas of the plate. Print paper 166 is registered over artwork 164 such that the characteristic intaglio plate mark will be received on the paper. Often the paper is dampened to be more receptive to the ink and more supple to be pressed into the incised marks and to further enhance the print mark. One or more felt blankets 170 are placed over print paper 166 in preparation for the press, but one or more layers of absorbent paper 168 may be inserted between print paper 166 and felt 170 to protect the felt from any superfluous ink.

Platen 162 is repositioned along wing assembly 150 toward the receiving side so that print head assembly 110 is aligned for the first pass. On the initial pass, print roller 116 of print head assembly 110 should be positioned such that the pass will overlap the leading edge of transfer paper 166 (usually the first pass covers both leading edges transfer paper 166 and artwork 164). Typically, subsequent passes will overlap the previous pass by some nominal amount to assure a quality print, perhaps 25% of the width of the pass.

With the workpiece in position, print head assembly 110 is lowered from the parked position above the workpiece to the ready position (the ready position is represented as position 110B in FIG. 8A) with print roller 116 in contact with felt 170 on FIG. 8A. Usually, the starting position for print head assembly 110 is on top of artwork 164 and print paper 166. In this starting position, print head assembly 110 need not climb the incline created by artwork 164 and print paper 166 as discussed below. The alignment between print roller 116 and platen 162 is verified and then the operator applies a downward force to handles 113. Print head assembly 110 tilts slightly until bearing 118 contacts wear plate 122 where the print head is in the operation position (the operation position is represented as position 110C in FIG. 8A). With a firm grasp on both handles 113, the operator then applies the proper amount of force for the print. For instance, if the operator applies 15 lbs. on each handle, 300 lbs. of force will result at print roller 116, assuming print head assembly has an approximate 10:1 mechanical advantage. Print roller 116 is then forced along runway 104 and over the workpiece in the direction indicated by the arrow in the figures. As a practical matter, the operational passes may be in one direction only or in both directions, but optimally is rolled from the center portion of print paper 166 and off one edge and then repositioned on print paper 166 and rolled n the opposite direction off the opposing edge of artwork 164 and print paper 166. In so doing, print roller 116 never climbs the higher edge created by artwork 164 and print paper 166, but is roller off of that edge onto the slightly lower elevation of the felt-covered platen 162. Knowledge of the type of printing being performed will partially determine the optimal type of pass.

When a pass is completed, print head assembly 110 is returned to the parked position 110A above the workpiece and platen 162 is repositioned along wing assembly 150 toward the receiving side, with some allowance for overlap of the previous pass. The operation continues until all of artwork 164 and the finished print are on the receiving side. Print paper 166 is separated from artwork 164, absorption paper 168 and felt 170 and allowed to dry.

As mentioned above, the precise amount of force applied to handles 113 by the operator is somewhat subjective. Furthermore, even if the precise amount of pressure is known and well understood for a particular operation, often an operator will have difficultly gauging the amount of force that is necessary to produce that amount of pressure. Various types of compact strain gauges are known that can provide the operator with digital feedback of the precise amount of compression being applied. Another type of feedback is a tactual feedback, i.e., feedback by touch.

Figure 10B:
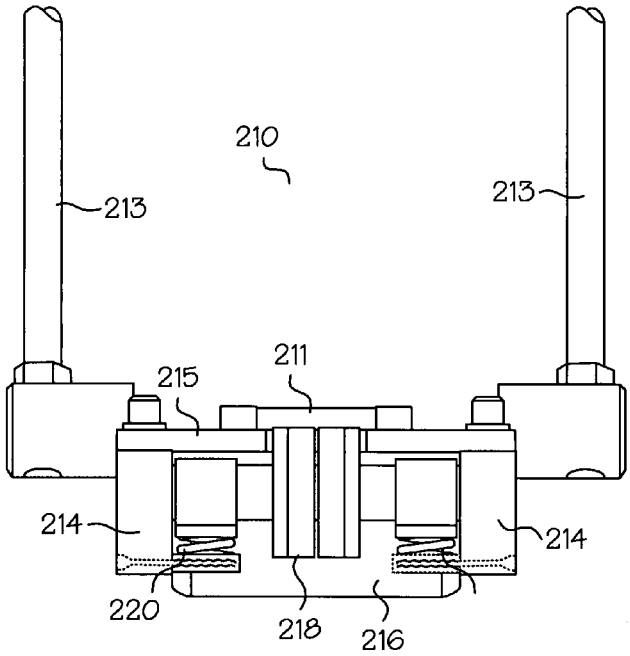
FIG. 10B is a feed side view of a print head assembly showing the placement of the pressure spring in accordance with an exemplary embodiment of the present invention.
Figure 10C:
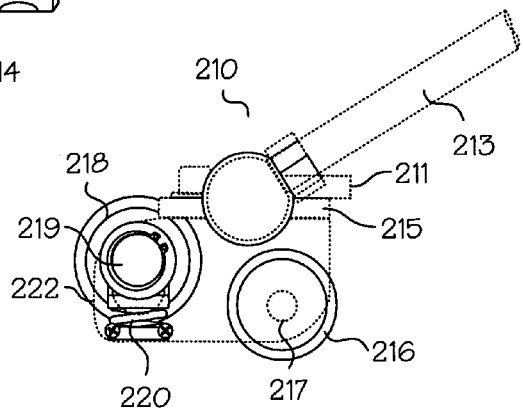
FIG. 10C is a receiving side view of a print head assembly showing the pressure slot in accordance with an exemplary embodiment of the present invention.
Figure 10A:
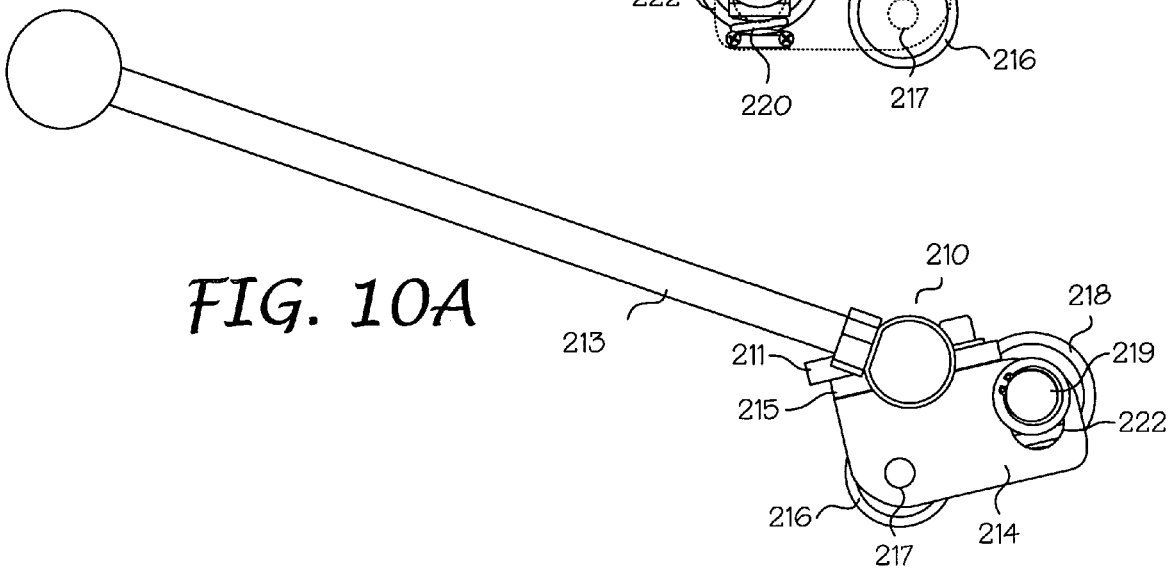
FIG. 10A is a front view of a print head assembly which includes a pressure spring in accordance with an exemplary embodiment of the present invention.
Figure 11:
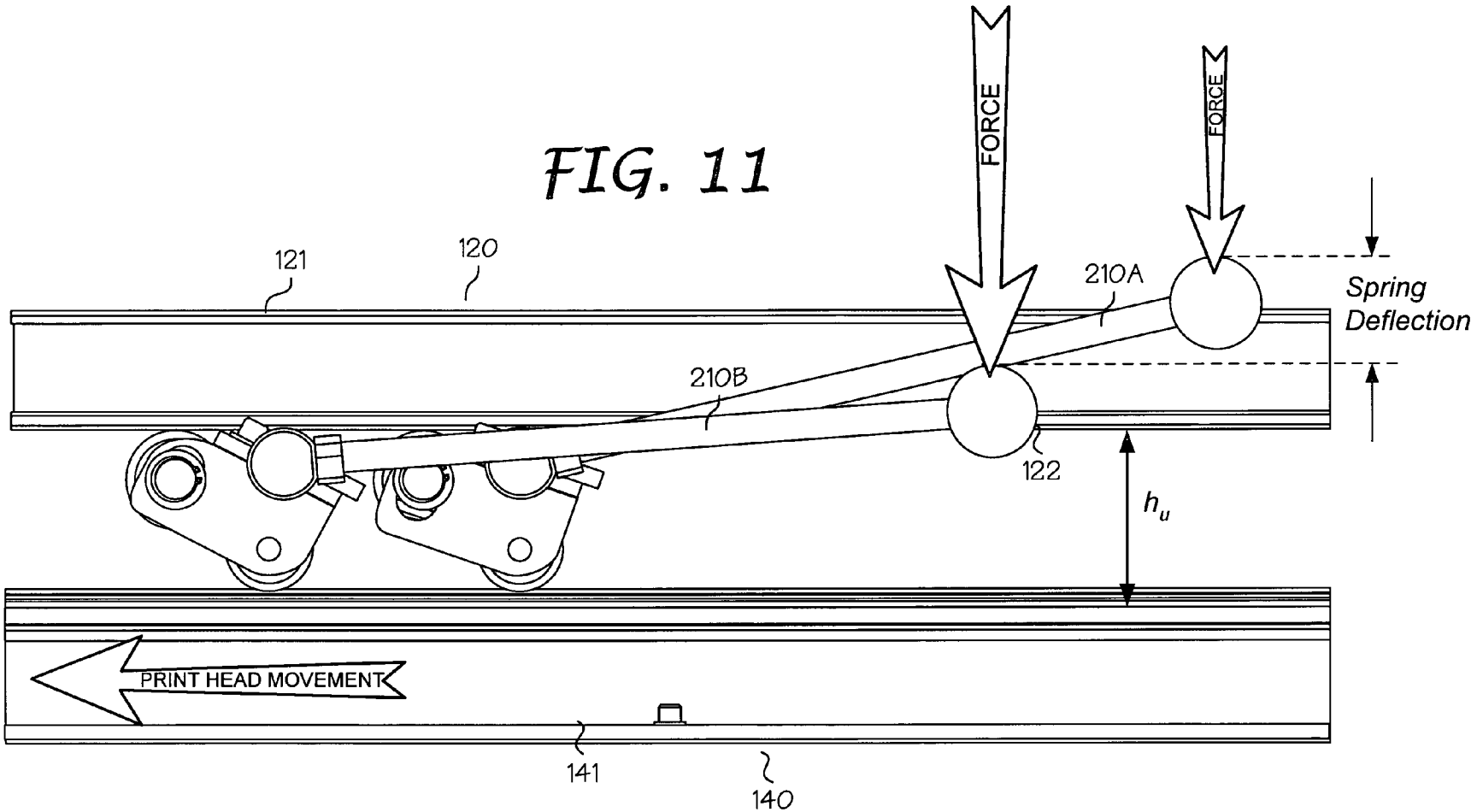
FIG. 11 is a diagram a print head assembly including a pressure spring showing the orientations of the print head assembly with the spring relaxed and the spring compressed in accordance with other exemplary embodiments of the present invention.

With reference now to FIGS. 10A through 10C, various view angles of a print head assembly with a tactual feedback mechanism are depicted in accordance with exemplary embodiments of the present invention. FIG. 11 is a diagram showing the tactual response of the print head assembly received by the operator. Here, the aim is for the operator to receive a tactual sensation whenever a threshold amount of pressure has been exceeded. Print head assembly 210 is substantially similar to print head assembly 110 discussed above with reference to FIGS. 6A through 6G, i.e., a pair of rollers mounted within a housing, with one or more lever handles. Print roller 216 is held on axle 219 between a pair of pillow block frames 214, that are further secured to frame deck 215. Track roller 218 is secured along axle 217 at the opposite extreme of pillow block frames 214 from print roller 216. The difference between print head assembly 110 and print head assembly 210 is that track roller 218 and axle 217 are not rigidly secured to pillow block frames 214, but instead are secured to pillow block frames 214 through a pair of compression springs 220. Also provided is elongated slot 222 in each of pillow block frames 214. The purpose of the spring and slot combination is to allow track roller 218 and axle 217 to be received within print head assembly 210, along elongated slots 222 in pillow block frames 214. The distance that track roller 218 and axle 217 move proportional to the amount of pressure by the operator, over a threshold determined by the state of compression in springs 220. For instance, if compression springs 220 are being held under 100 lbs. of tension, then track roller 218 and axle 217 will begin to move after 100 lbs. of force has been applied to compression springs 220 by the operator. That is not to say that the operator exerts 100 lbs. on lever handles 213, but the magnitude of the force. In another example, suppose the optimal amount of force necessary for producing a quality print is 300 lbs., that is 300 pounds of force must be received at print roller 216. Assuming a 10:1 efficiency, then the operator must manually exert 30 lbs. on the handle to realize 300 lbs. at the print roller. By summing the forces it is apparent that the force at track roller 218 will be 270 lbs (300 lbs.−30 lbs.=270 lbs.). Therefore, in this example for a threshold of 300 lbs., the tension n springs 220 should be set to approximately 270 lbs. In so doing, the operator would receive the tactual feedback response at handles 213 when he exceeds a force of 30 lbs. on the handles, i.e., the handles will move or give slightly as springs 220 compress. FIG. 11 shows print head assembly 210 in the operating position 210A and then after the tactual response from exceeding the threshold amount as position 210B. The amount of force necessary to move track roller 218 and axle 217 along elongated slot 222 from the upper and lower positions can be calculated in advance, giving the operator means to accurately measure the amount of pressure being transferred to the workpiece.

Alternatively, and in accordance with another exemplary embodiment of the present invention, the spring and slot arrangement may be applied to print roller 216 rather than the track roller. The sides of pillow block frames 214 would be thinned somewhat to allow for the travel of print roller 216. This embodiment has the additional advantage of aiding print roller 216 to negotiate the change in height at the edge of the artwork. Alternatively, a torsion spring arrangement may be installed between handles 213 and frame deck 215 for producing a similar tactual affect.

The present invention has been described with regard to embodiments of a portable intaglio press. It should be understood that aspects of the present invention are applicable to any type of press, regardless whether it is lightweight or portable. Also, certain modifications could easily be accomplished without departing from the scope or spirit of the inventions. For instance, the press might be fitted with a plurality of parallel upper beam assemblies and wear plates that correspond to a plurality of track rollers disposed on the print head assembly. Furthermore, the print head assembly may be fitted with a single lever handle that protrudes between any two upper beam assemblies. The operator would then apply force to only this single grip (the distal end would be fitted with a T-grip for stability during operation). Furthermore, while the present invention has been described as being a manual press, certain automated features may be included, such as providing rotational power to one or both of the track and print rollers for making print passes.

The exemplary embodiments described below were selected and described in order to best explain the principles of the invention and the practical application, and to enable others of ordinary skill in the art to understand the invention for various embodiments with various modifications as are suited to the particular use contemplated. The particular embodiments described below are in no way intended to limit the scope of the present invention as it may be practiced in a variety of variations and environments without departing from the scope and intent of the invention. Thus, the present invention is not intended to be limited to the embodiment shown, but is to be accorded the widest scope consistent with the principles and features described herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. A printing press comprising:

a press bed assembly, comprising:

an upper support assembly, said upper support assembly having a lower support surface; and a lower support assembly, said lower support assembly having an upper support surface, at least a portion of the upper support surface being substantially parallel to the lower support surface; and a print head assembly, comprising:

a print head frame;

a print roller, said print roller rotationally secured by the print head frame at a first position;

a first roller, said first roller rotationally secured by the print head frame at a second position, said second position on the print frame being horizontally offset from the first position on the print frame in a first horizontal direction by a first horizontal distance and said first roller being adapted for contacting and rotationally traversing the lower support surface of the upper support assembly; and a torque arm, said torque arm having a first end secured to the print head frame and a handle end distally situated from the print head frame and said handle end being horizontally offset from the second position on the print frame in the first horizontal direction by a second horizontal distance, said torque arm being adapted for generating a first downward force on the upper support surface of the lower support assembly from the print roller by receiving a second downward force at said handle end, wherein a first magnitude of the first downward force is greater than a second magnitude of the second downward force and, the first magnitude is proportional to the second magnitude based on a difference between the second horizontal distance and the first horizontal distance.

2. The printing press device recited in claim 1, wherein the press bed assembly further comprises:

a platen, at least a portion of the platen positioned between the upper support surface of the lower support assembly and the lower support surface of the upper support assembly.

3. The printing press device recited in claim 2, wherein the press bad assembly further comprises:

a platen support for slidably supporting the platen.

4. The printing press device recited in claim 3, wherein the platen support further comprises:

a guide for constraining a movement of the platen to a slide direction.

5. The printing press device recited in claim 4, wherein the print roller is substantially parallel to the upper support surface of the lower support assembly.

6. The printing press device recited in claim 2, wherein the upper support assembly has a width and the print head assembly further comprises:

a second torque arm having a first end, wherein the first end of the second torque arm is secured to the print head frame by a distance from the first end of the torque arm that is greater than the width of the upper support assembly.

7. The printing press device recited in claim 6, wherein in operation, the torque arm and second torque arm are oriented within twenty degrees of horizontal.

8. The printing press device recited in claim 6, wherein an angle between a plane defined by the torque arm and second torque arm and a second plane defined by the axes of the print roller and the first roller is determined by the torque arm and the second torque arm being oriented within twenty degrees of horizontal in operation.

9. The printing press device recited in claim 1, wherein the combination of the print roller, the first roller and the torque arm are adapted for exerting a first force on the upper support surface of the lower support assembly and a second force on the lower support surface of the upper support assembly in response to a manual force being on the torque arm exerted proximate to the distal end.

10. The printing press device recited in claim 1, wherein the press bed assembly further comprises:

a pair of end supports, the pair of end supports adjoining the upper support assembly and lower assembly with at least a portion of the lower support surface and the upper support surface between the pair of end supports.

11. The printing press device recited in claim 10, wherein one of the upper support assembly and the lower support assembly is adjustable for altering a distance between the upper support assembly and the lower support assembly.

12. The printing press device recited in claim 11, wherein the upper support assembly is adjustable for altering a vertical distance between the upper support assembly and the lower support assembly.

13. The printing press device recited in claim 12, wherein at least a portion of the upper support surface and a portion of the lower support structure lie in a horizontal plane.

14. The printing press device recited in claim 12, wherein the press bed assembly further comprises:

an adjustment mechanism for adjustably coupling the upper support assembly to the pair of end supports.

15. The printing press device recited in claim 14, wherein the adjustment mechanism further comprises:

a fastener; and an adjustment slot in one of the upper support assembly and the pair of end supports, said adjustment slot for receiving the fastener.

16. The printing press device recited in claim 14, wherein the press bed assembly further comprises:

a roller height gauge, said roller height gauge indicating a relative height of the upper support assembly.

17. The printing press device recited in claim 1, wherein one or both of the print head assembly and the press bed assembly further comprises:

attachment mechanism for securing the print head assembly above the lower support assembly.

18. The printing press device recited in claim 17, wherein at least a portion of the upper support assembly is comprised of a ferrous material, and at least a portion of the print head assembly is comprised of a magnetic material.

19. The printing press device recited in claim 17, wherein at least a portion of the upper support assembly is comprised of a magnetic material, and at least a portion of the print head assembly is comprised of a ferrous material.

20. The printing press device recited in claim 1, wherein a longitudinal axis of the print roller is substantially parallel to the upper support surface of the lower support assembly.

* * * * *